United States Patent [19]

Garland

[11] 4,378,680

[45] Apr. 5, 1983

[54] SHELL AND TUBE ICE-MAKER WITH HOT GAS DEFROST

[75] Inventor: Milton W. Garland, Waynesboro, Pa.

[73] Assignee: Frick Company, Waynesboro, Pa.

[21] Appl. No.: 309,749

[22] Filed: Oct. 8, 1981

[51] Int. Cl.[3] ..... F25C 5/10

[52] U.S. Cl. ..... 62/352; 62/278; 62/348

[58] Field of Search ..... 62/352, 347, 348, 81, 62/196 B, 278; 137/112

[56] References Cited

U.S. PATENT DOCUMENTS

| | | | |
|---|---|---|---|
| 2,239,234 | 4/1941 | Kubaugh . | |
| 2,618,129 | 11/1952 | Williams, Jr. . | |
| 2,721,452 | 10/1955 | Brandin et al. . | |
| 2,739,457 | 3/1956 | Chapman . | |
| 2,807,150 | 9/1957 | Chapman . | |
| 2,807,152 | 9/1957 | Chapman . | |
| 3,026,686 | 3/1962 | Lowe | 62/352 X |
| 3,053,058 | 9/1962 | Kocher . | |
| 3,068,660 | 12/1962 | Council et al. | 62/352 X |
| 3,206,945 | 9/1965 | Nilsson et al. . | |
| 3,280,585 | 10/1966 | Lowe . | |
| 3,435,633 | 4/1969 | Dixon . | |
| 3,759,061 | 9/1973 | Nilsson et al. . | |
| 3,769,812 | 11/1973 | Gordon . | |
| 3,803,871 | 4/1974 | Karas . | |
| 3,922,875 | 12/1975 | Morris, Jr. | 62/352 X |
| 4,094,168 | 6/1978 | Hammer et al. . | |
| 4,107,943 | 8/1978 | Ohling | 62/347 X |

*Primary Examiner*—William E. Tapolcai
*Attorney, Agent, or Firm*—Dowell & Dowell

[57] ABSTRACT

A shell and tube ice-maker has a bottom compartment in which trapped refrigerant gas is present to prevent entry of liquid refrigerant into the compartment during ice-making and from which, during defrosting, hot gaseous refrigerant flows upwardly into the liquid refrigerant which remains in flooded condition around the tubes, whereby delay in initiating further ice-making is minimized.

7 Claims, 6 Drawing Figures

33
24
33
3
29
24
23
3
26

Fig. 3
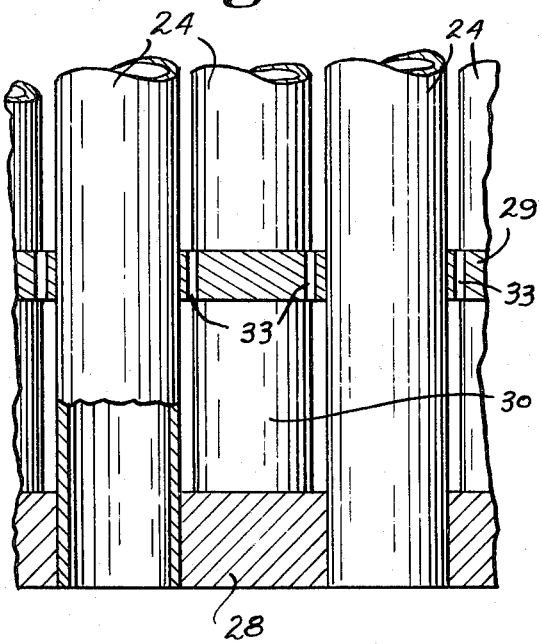
Fig. 4
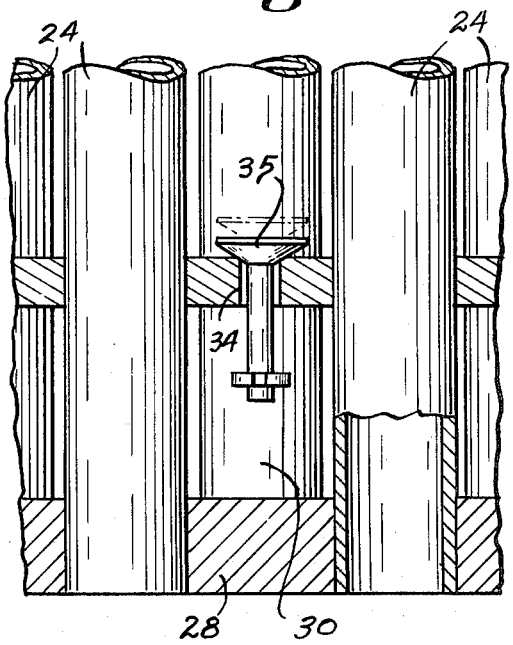
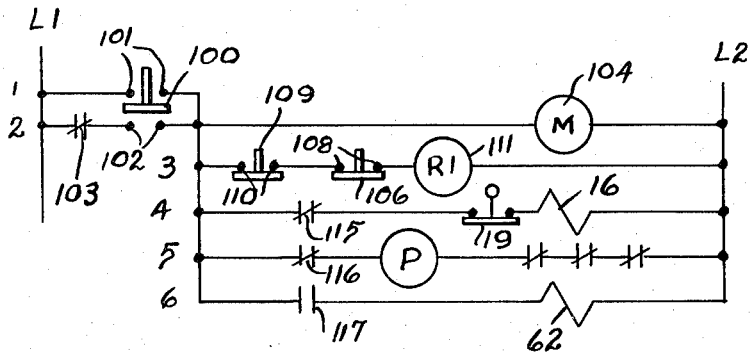
Fig. 5
Fig. 6
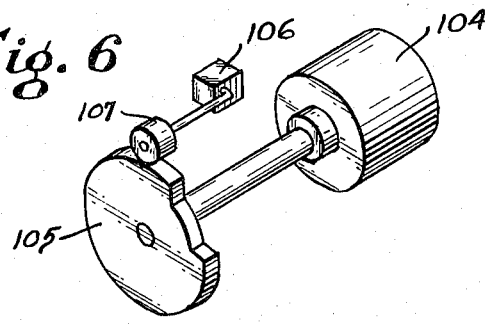

SHELL AND TUBE ICE-MAKER WITH HOT GAS DEFROST

TECHNICAL FIELD

This invention relates to refrigeration and more particularly to efficiently making ice in tubes with a minimum delay between cycles.

BACKGROUND ART

Refrigeration equipment for making ice on or within refrigerated tubes has been know for many years. In my U.S. Pat. No. 4,185,467 defrosting to free the ice is done by relatively warm liquid refrigerant.

In Nilsson et al U.S. Pat. No. 3,759,061, gaseous refrigerant for defrosting is brought into a compartment at the lower ends of the ice filled tubes but prior thereto the liquid refrigerant around the tubes is removed.

Other patents in the art include Williams, Jr. No. 2,618,129; Brandin et al No. 2,721,452; Kara No. 3,803,871; Chapman No. 2,807,152, 2,739,457 and 2,807,150; Kocher No. 3,053,058; Lowe No. 3,280,585; Gordon No. 3,769,812; Hammer No. 4,094,168; Nilsson et al No. 3,206,945; Kubaugh No. 2,239,234; and Dixon No. 3,435,633.

Co-Pending Application

In my co-pending application Ser. No. 242,219, filed March 10, 1981, the ice formed on the outsides of tubes is defrosted by relatively warm gaseous refrigerant which flows first into a compartment at the lower ends of the tubes and then upwardly within the tubes and into the liquid refrigerant.

SUMMARY OF THE INVENTION

The present invention includes in a shell and tube ice-maker, the provision of a false bottom defining an enclosed space about a portion of the tubes and such space contains trapped gaseous refrigerant during freezing and which has restricted means permitting hot gaseous refrigerant to flow upwardly into the liquid refrigerant during defrosting where it condenses, thereby providing the required heat for freeing of the ice in the tubes. The time for defrosting and for recommencing ice-making is relatively short since the charge of liquid refrigerant is substantially maintained around the tubes at all times. Appropriate controls for automatically running the equipment through continuing cycles is provided.

Accordingly, it is an object of the invention to provide a shell and tube ice-maker which provides for the efficient manufacture of a tube of ice, releasing it from the tube in which it is formed and commencing the formation of the next tube of ice with minimum delay.

BRIEF DESCRIPTION OF THE DRAWINGS

FIG. 3 is a fragmentary sectional view taken on the line 3—3 of FIG. 2.

FIG. 4 is a fragmentary sectional view similar to FIG. 3 and illustrating another embodiment of the invention.

FIG. 5 is a schematic diagram of the control circuit for operating the apparatus.

FIG. 6 is a perspective view illustrating the timing mechanism for the apparatus.

DESCRIPTION OF THE PREFERRED EMBODIMENT

Freezing Apparatus

Figure 1:
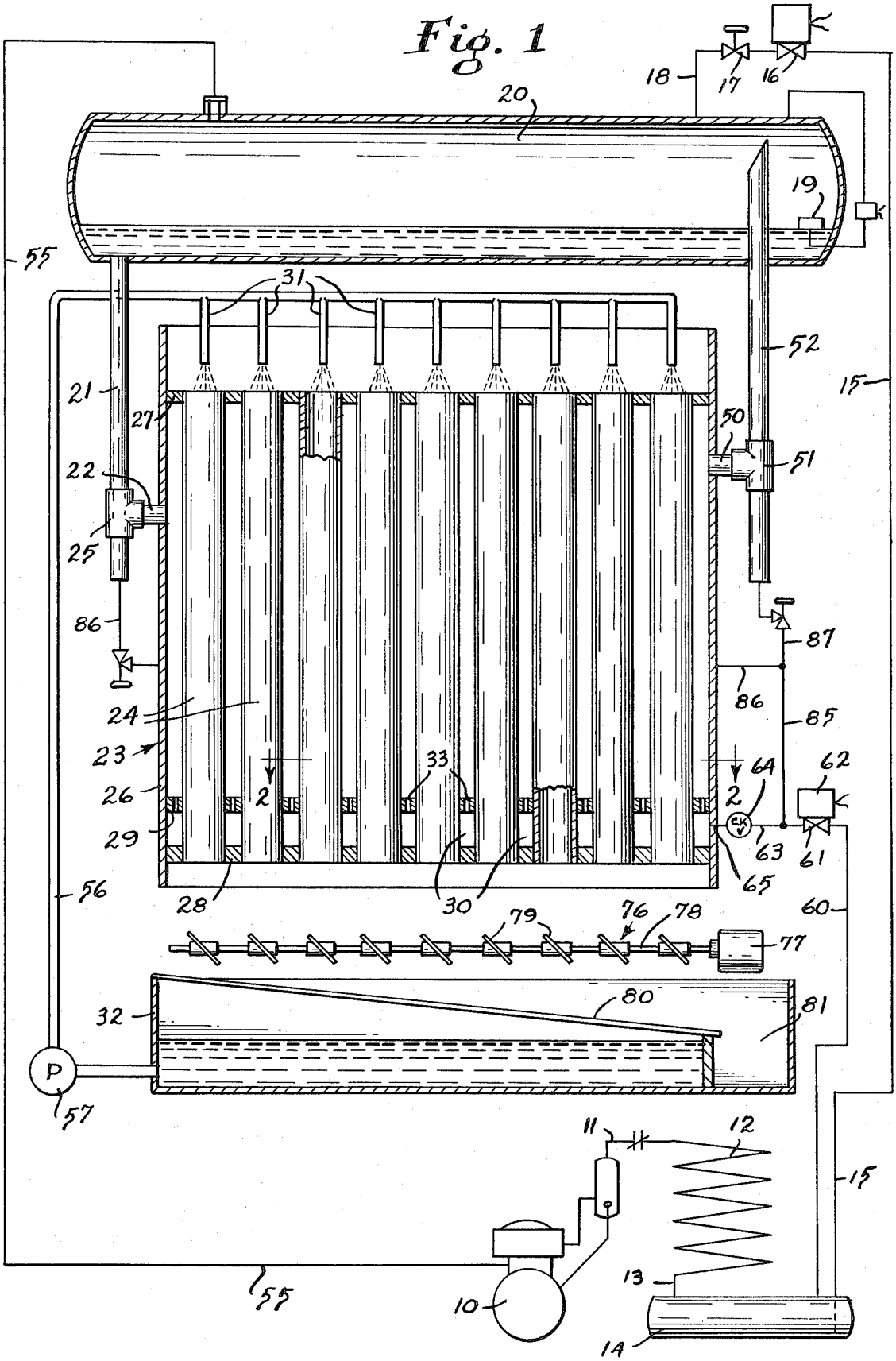
FIG. 1 is a schematic illustration of ice-making apparatus in accordance with the present invention.
Figure 2:
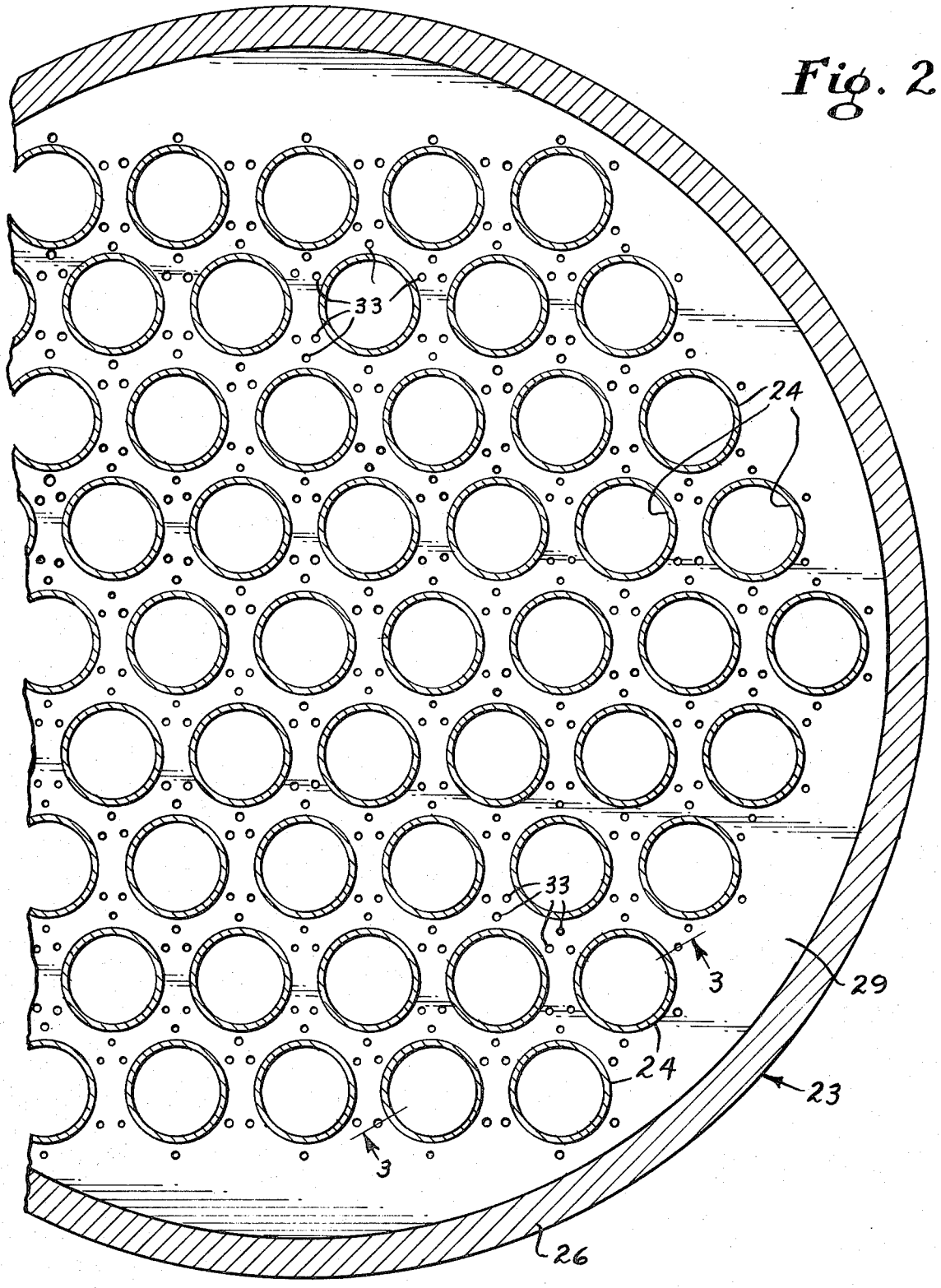
FIG. 2 is an enlarged sectional view taken on the line 2—2 of FIG. 1.

With continued reference to the drawings, there is illustrated a conventional compression type refrigeration system including a compressor 10 which discharges into a line 11 to a condenser 12, and line 13 to refrigerant receiver 14. From the latter, line 15 delivers liquid refrigerant as required during the freezing mode to solenoid operated valve 16 and then through a manually operated valve 17 which controls modulated flow to line 18 to separator-accumulator 20. The separator-accumulator has a liquid level float switch 19 whose purpose is to maintain a predetermined level of liquid refrigerant therein by selectively controlling the solenoid operated valve 16 and introducing makeup refrigerant from the receiver 14 into the separator-accumulator.

From separator-accumulator 20 there is a liquid downflow conduit 21 into pipe 22 which feeds liquid by gravity into the shell 23 and around ice-making tubes 24 in an amount sufficient to maintain a substantially flooded condition during the freezing cycle. Flow from conduit 21 into the pipe 22 normally is controlled by a valve 25 whose operation will be described later.

The shell 23 has a side wall 26, an upper wall 27 and bottom wall 28 and the tubes 24 are rigidly connected to such upper and bottom walls. Spaced above the bottom wall 28 is an inner or false bottom wall 29 forming a compartment or plenum chamber 30 with the bottom wall 28.

The upper ends of the tubes are open at the upper wall 27, the side wall 26 extending upwardly therebeyond to facilitate the flow of water from a plurality of spray nozzles 31 into the tubes. At their lower ends the tubes are open at the bottom wall 28, so that ice may be discharged therefrom into a sump 32.

The inner wall 29 snugly receives the tubes so that any passage of refrigerant in either liquid or gaseous form past the tubes is negligible.

In order, during defrosting, to pass gaseous refrigerant from the compartment 30 upwardly into the liquid refrigerant within the shell, the bottom wall 29 is provided with a plurality of holes or openings 33. These holes are of a size and number to permit upward passage of the required amount of gaseous refrigerant for defrost purposes but are small enough to prevent any substantial downward flow of liquid refrigerant during the freezing phase. It has been found, for example, that at the temperature and pressure conditions commonly used in this type of refrigeration equipment, and with an inner bottom plate approximately one inch (25.40 mm) in thickness, that the holes should not exceed approximately 3/16 inch (4.765 mm) in diameter. If a thinner plate were used, e. g. one half inch (12.7 mm), then the holes should not exceed approximately $\frac{1}{8}$ inch (3.175 mm) in diameter. By keeping the holes small enough, the surface tension of the liquid reduces the liquid leakage into the compartment 30 to an acceptable level. Furthermore, when the freezing phase commences, any small amount of liquid that may pass into the compartment 30 is vaporized by the heat from the remaining hot gases within such compartment and by the water flowing downwardly in the tubes and the trapped vapor builds a pressure within the compartment that tends to escape upwardly and thereby tends to restrict or prevent the downward flow of liquid through the holes 33.

In the modification of FIG. 4, larger holes 34 are provided, each having a check valve assembly 35. While this form more positively prevents any leakage of liquid refrigerant downwardly into compartment 30, the problem of maintenance of a multiplicity of valve assemblies in a sealed unit is inherent and indicates the use of small non-valved holes as earlier described, as a practical matter.

For example, during the freezing cycle, liquid refrigerant is completely or substantially prevented from entering the compartment or plenum chamber 30 between the bottom wall 28 and the inner wall 29. Thus, gas is trapped therein and any formation of ice in the bottoms of the tubes in the bottom compartment during the freezing mode is so small that the ice release time during defrosting is not increased.

From the upper portion of the shell, a pipe 50 is connected by a valve 51 to up-pipe 52 which extends to the upper portion of the separator-accumulator 20 above the liquid level therein. The pipe 50 is located at an elevation higher than the inlet pipe 25 but spaced from the upper wall 27 to reduce the freezing of ice in the extreme upper ends of the tubes 24.

From the upper portion of the separator-accumulator, a vapor return line 55 is connected to the suction side of the compressor 10.

Equipment for flowing water into the tubes is similar to that disclosed in my patent 2,870,612. It includes a supply pipe 56 for discharging water through nozzles 31, the water freezing in the tubes and the excess falling into the container 32 from which it is recirculated by pump 57. Make-up water for the sump or container 32 is supplied by conventional apparatus (not shown) which may include a float valve within the sump.

Defrosting and Harvesting Apparatus

In order to remove the ice from the tubes, provision is made for the introduction of relatively warm gaseous refrigerant during the time (a) that the flow of water into the tubes is stopped, (b) the feed of liquid refrigerant from the separator-accumulator into the shell is stopped, and (c) the flow of gaseous refrigerant from the shell to the separator-accumulator is stopped.

From the receiver 14, a line 60 for hot gaseous refrigerant extends from the upper portion of the receiver to a valve 61 controlled by solenoid 62 to line 63 having check valve 64 to hot gas inlet opening 65 in the shell wall leading into compartment 30. Within the compartment 30 the hot gaseous refrigerant warms the bottoms of the tubes and then continues upwardly through the openings or holes 33 (or check valve openings 34) into the liquid refrigerant within the shell and around the tubes 25. The hot gaseous refrigerant heats the liquid refrigerant within the shell as well as the tubes to a temperature above the freezing point of water to release the ice from the inner surfaces of the tubes.

The cylinders of ice slide downwardly from the tubes into contact with a conventional breaker member 76. If desired, the breaker member may include a power plant 77 which drives a shaft 78 on which one or more breaker bars 79 are mounted below each tube and such breaker bars break the ice cylinders into chunks or fragments which fall by gravity onto a grid 80. Such grid is inclined to deflect the ice chunks into a collecting area 81 from which they may be removed in any conventional manner. The power plant 77 is operated in any conventional manner and in timed relationship with the harvesting mode of the ice-maker.

In order to stop the refrigerant flow from and to the separator-accumulator 20 during defrosting and harvesting, a line 85 communicates with the line 63 and such line 85 is connected by line 86 to the valve 25 that controls flow from the separator-accumulator down pipe 21 into the pipe 22. Line 85 is also connected by line 87 to the valve 51 that controls flow from pipe 50 to the separator-accumulator 20. Thus, when hot gas flows through the lines 63 and 85 into lines 86 and 87, the valves 25 and 51 move into closed position.

Control System

As generally described in patent 2,870,612, the apparatus is set to operate for a cycle of predetermined time depending on the thickness of ice desired to be formed in the tubes.

With reference to FIG. 5, the controls are illustrated in condition during the freezing mode. Line 1 has a manually controlled on-off switch 100 which in the upper position across contacts 101 permits testing of the ice-maker control system without operating the compressor 10.

Line 2 includes contacts 102 and switch 103, the latter being a compressor motor interlock and closed only when the compressor motor is operating. Line 2 also includes a program motor 104 which drives a cam 105 that controls the opening and closing of a switch 106 from the action of a roller or other cam follower 107 which follows the contour of the cam 105. The program motor makes a complete revolution in a predetermined time as, for example, a twelve minute cycle.

In line 3, contacts 108 are bridged by switch 106, the line including a manually operated switch 109 having contacts 110 which permits harvesting regardless of the cam position, and a relay R1, 111.

Line 4 includes a normally open relay contact 115 which is closed by operation of relay R1, 111, and such relay contact controls the solenoid operated valve 16 to permit liquid refrigerant to flow into separator-accumulator 20. The float valve 19 is located in line 4 and also controls the solenoid operated valve 16 so that liquid refrigerant may be added to the separator-accumulator only on demand during the freezing mode.

Line 5 includes normally open relay contact 116, which is closed by operation of relay R1, 111, and such relay contact 116 controls the operation of the water pump 57 during the freezing mode of the cycle and interrupts the operation of such water pump during the harvesting mode.

Line 6 includes a normally closed relay contact 117 which is opened by operation of relay R1, 111, thus keeping solenoid 62 de-energized and its valve 61 which supplies hot gas closed during the freezing cycle.

Operation

During the freezing operation, liquid refrigerant is introduced into the shell through the conduits 21 and 22 and the valve 25 while water is being sprayed into the tubes 24. Heat is absorbed from the water to produce ice. The gaseous refrigerant vapor is discharged from the shell from the conduits 50 and 52 and the valve 51 into the upper portion of the separator-accumulator where such gaseous vapor is returned to the compressor 10.

When the freezing operation has been completed the valves 25 and 51 are closed and simultaneously hot refrigerant gas from the upper portion of the receiver is introduced into the compartment or plenum chamber 30 through the check valve 64 and such hot gas passes upwardly through the openings 33 (or check valves 34) into the liquid refrigerant within the shell. At the time that the flow of refrigerant to and from the shell is interrupted, the liquid refrigerant therein ceases to boil and the liquid level drops further below the discharge conduit 50.

When the hot gaseous refrigerant is forced upwardly through the openings in the inner bottom, the liquid refrigerant within the shell is heated to a temperature substantially above the freezing temperature of water and such heat passes through the metal of the tubes to release the column of ice therein. The release of the ice occurs from the bottom up so that the lower portion of the column of ice is released prior to the release of the upper portion. The hot gaseous refrigerant being introduced into the shell through the openings in the inner bottom is condensed by the liquid refrigerant within the shell which again causes the level of the liquid to rise. At the end of the time period for harvesting, all of the ice will have been freed from the tubes and will have fallen into the sump 32.

At the completion of the harvesting mode the introduction of hot gaseous refrigerant into the compartment 30 is interrupted and the valves 25 and 51 are opened to again permit the introduction of liquid refrigerant into the shell and remove refrigerant vapor therefrom while water is again introduced through the nozzles 31 and sprayed into the tubes. Since the hot gaseous refrigerant within the compartment 30 cannot escape due to the check valve 64, the compartment remains pressurized and such pressure, together with surface tension, is sufficient to substantially prevent the liquid refrigerant in the shell from passing downwardly through the openings. Any small amount of liquid refrigerant which passes into the compartment 30 will be vaporized by the gas and by the water which flows downwardly through the tubes to increase the pressure within such compartment.

As an example, a shell and tube ice-maker has been tested in which the shell has an inner diameter of approximately 15 inches (38.10 cm) so that the inner bottom has an area of 176.72 square inches (1,140.20 sq. cm). Within the shell a total of 61 tubes have been provided with each of such tubes having an outer diameter of 1.25 L inches (3.175 cm) so that the tubes occupy an area of approximately 74.86 square inches (483.00 sq. cm). Accordingly, the remainder of the inner bottom includes an area of 101.86 square inches (657.20 sq. cm). Regardless of whether the inner bottom is provided with relatively small orifices or foramens or whether the plate has larger openings normally closed by check valves 35, the area of such openings is approximately 5.89 square inches (38.00 sq. cm) or substantially 17% of the area of the inner bottom between the tubes.

During the freezing process, liquid refrigerant is introduced into the shell to cause the water within the tubes to freeze into columns of ice, the liquid producing a working temperature of approximately 15° F. During the harvesting mode, hot refrigerant gas of approximately 80°-90° F. from the receiver is introduced into the compartment 30 and this gas passes upwardly into the liquid refrigerant to raise the temperature of the refrigerant and the metal of the tubes to approximately 45° F. to release the ice from the inner periphery of such tubes. As soon as the harvesting operation has been completed and the valves 25 and 51 are opened, and the flow of water resumed, the liquid refrigerant within the shell begins to be vaporized again substantially immediately so that the freezing operation may commence without delay. With this structure, there is no time delay either in purging the shell of liquid refrigerant after the freezing process is completed or in filling the shell with liquid refrigerant after the harvesting has been completed.

I claim:

1. Apparatus for producing and harvesting ice intermittently comprising vertical shell means having tube means therein, means for supplying water to the interior of said tube means, an accumulator-separator for refrigerant, a first conduit means connecting the lower portion of said accumulator-separator to said shell means for supplying liquid refrigerant thereto, a second conduit means connecting the upper portion of the accumulator-separator to the shell means for withdrawing gaseous refrigerant from said shell means, said first and second conduit means being connected to spaced portions of the shell means so that liquid and gaseous refrigerant flow through the shell means is in the same direction during ice making, said shell means having a false bottom at its lower portion which snugly engages said tub means and which constitutes a wall of an enclosed space, restricted flow means in said false bottom, said flow means comprising apertures of predetermined size located intermediate said tube means and substantially preventing liquid flow but permitting gaseous flow, means for supplying relatively high temperature and pressure gaseous refrigerant to the space beneath the false bottom for upward flow through said flow means into said shell means and to cause release of ice from the tube means, and means for retaining the liquid refrigerant within said shell means when said relatively high temperature and pressure gaseous refrigerant is supplied to the space beneath the false bottom for harvesting the ice.

2. The invention of claim 1, and means for supplying liquid refrigerant to said accumulator-separator during ice-making, and stopping said supply during defrosting of said tubes.

3. Apparatus for intermittently producing and harvesting ice comprising shell means having top and bottom walls, a plurality of generally vertical tube means located within said shell means and extending through said top and bottom walls, an inner wall spaced from said bottom wall and generally parallel thereto providing a plenum chamber in the lower portion of said shell means, first conduit means for introducing liquid refrigerant into said shell means between said top wall and said inner wall, second conduit means located at a higher elevation than said first conduit means for withdrawing gaseous refrigerant from said shell means so that liquid and gaseous refrigerant flow through said shell means is in the same direction during ice making, means for introducing water into said tube means for forming ice on the interior thereof during ice making, said inner wall snugly engaging said tube means and having restricted flow means extending generally vertically therethrough, said restricted flow means comprising apertures of predetermined size located intermediate said tube means and substantially preventing the flow of liquid refrigerant into said plenum chamber but permitting gaseous fluid to flow from said plenum chamber into the liquid refrigerant within said shell means during harvesting, means for supplying relatively high temperature and pressure gaseous fluid to said plenum chamber during the harvesting, and means for retaining the liquid refrigerant within said shell means when said relatively high temperature and pressure gaseous refrigerant is supplied to the space beneath the false bottom for harvesting the ice, whereby the gaseous fluid is discharged from said plenum chamber into the liquid refrigerant within said shell means to release the ice from said tube means and permit the ice to fall by gravity therefrom.

4. The invention of claim 3 in which said gaseous fluid is refrigerant gas which is condensed by the liquid refrigerant within said shell means.

5. Apparatus for producing and harvesting ice intermittently comprising vertical shell means having tube means therein, means for supplying water to the interior of said tube means, an accumulator-separator for refrigerant, a first conduit means connecting the lower portion of said accumulator-separator to said shell means for supplying liquid refrigerant thereto, a second conduit means connecting the upper portion of the accumulator-separator to the shell means for withdrawing gaseous refrigerant from said shell means, said first and second conduit means being connected to spaced portions of the shell means so that liquid and gaseous refrigerant flow through the shell means is in the same direction during ice-making, said shell means having a false bottom at its lower portion which snugly engages said tube means and which constitutes a wall of an enclosed space, said false bottom having a plurality of openings intermediate said tubes, valve means associated with each of said openings, said valve means preventing flow of liquid downwardly beneath said false bottom but permitting upward flow of vapor when said valve means is open, means for supplying relatively high temperature and pressure gaseous refrigerant to the space beneath the false bottom for upward flow through said openings into said shell means and to cause release of ice from the tube means, and means for retaining the liquid refrigerant within said shell means when said relatively high temperature and pressure gaseous refrigerant is supplied to the space beneath the false bottom for harvesting the ice.

6. The invention of claim 5 in which said valve means includes a pressure operated check valve.

7. Apparatus for producing and harvesting ice intermittently comprising vertical shell means having tube means therein, means for supplying water to the interior of said tube means, an accumulator-separator for refrigerant, a first conduit means connecting the lower portion of said accumulator-separator to said shell means for supplying liquid refrigerant thereto, a second conduit means connecting the upper portion of the accumulator-separator to the shell means for withdrawing gaseous refrigerant from said shell means, said first and second conduit means being connected to spaced portions of the shell means so that liquid and gaseous refrigerant flow through the shell means is in the same direction during ice making, said shell means having a false bottom at its lower portion which constitutes a wall of an enclosed space, restricted flow means in said false bottom, said flow means substantially preventing liquid flow but permitting gaseous flow, means for supplying relatively high temperature and pressure gaseous refrigerant to the space beneath the false bottom for upward flow through said flow means into said shell means and to cause release of ice from the tube means, valve means in each of said first and second conduit means for controlling flow therethrough, and means for closing said valve means in response to flow of said gaseous refrigerant to said space beneath said false bottom.

* * * * *